US009534427B2

(12) United States Patent
Menke

(10) Patent No.: US 9,534,427 B2
(45) Date of Patent: Jan. 3, 2017

(54) MOTOR VEHICLE DOOR CLOSURE

(71) Applicant: Kiekert Aktiengesellschaft, Heiligenhaus (DE)

(72) Inventor: Johannes Theodor Menke, Velbert (DE)

( * ) Notice: Subject to any disclaimer, the term of this patent is extended or adjusted under 35 U.S.C. 154(b) by 114 days.

(21) Appl. No.: 14/386,027

(22) PCT Filed: Mar. 16, 2013

(86) PCT No.: PCT/DE2013/000153
§ 371 (c)(1),
(2) Date: Sep. 18, 2014

(87) PCT Pub. No.: WO2013/143522
PCT Pub. Date: Oct. 3, 2013

(65) Prior Publication Data

US 2015/0048632 A1 Feb. 19, 2015

(30) Foreign Application Priority Data

Mar. 28, 2012 (DE) ..... 20 2012 003 171 U

(51) Int. Cl.
*E05B 3/00* (2006.01)
*E05B 77/28* (2014.01)
(Continued)

(52) U.S. Cl.
CPC ..... *E05B 77/287* (2013.01); *E05B 77/26* (2013.01); *E05B 77/265* (2013.01); *E05B 81/06* (2013.01);
(Continued)

(58) Field of Classification Search
CPC ..... E05B 77/26; E05B 77/287; E05B 77/265; E05B 81/06; E05B 81/14; E05B 81/64; E05B 81/76; Y10T 292/57
(Continued)

(56) References Cited

U.S. PATENT DOCUMENTS 5,718,465 A * 2/1998 Dowling ..... E05B 65/0841 292/216
5,894,906 A * 4/1999 Weber ..... B60J 7/0573 180/274
(Continued)

FOREIGN PATENT DOCUMENTS

DE 19650661 A1 * 6/1998 ..... E05B 81/14
DE 19916733 A1 10/2000
(Continued)

OTHER PUBLICATIONS

Machine Translation of DE10259972B4 by Lexis Nexis Total Patent on Sep. 9, 2014.
(Continued)

*Primary Examiner* — Kristina Fulton
*Assistant Examiner* — Faria Ahmad
(74) *Attorney, Agent, or Firm* — Woodard, Emhardt, Moriarty, McNett & Henry LLP

(57) ABSTRACT

The invention relates to a motor vehicle door closure, comprising a locking mechanism, an electric drive (3, 4) for the locking mechanism, and a child-restraint element (14) with a corresponding sensor (15). The electric drive (3, 4) can be activated or deactivated in order to open the locking mechanism dependant on the position of the child-restraint element (14), said position being requested using the sensor (15). The activated child-restraint element (14) can be deactivated in an emergency operation by a switch (17), and the locking mechanism can be opened by the electric drive (3, 4).

18 Claims, 3 Drawing Sheets

Figure 1:
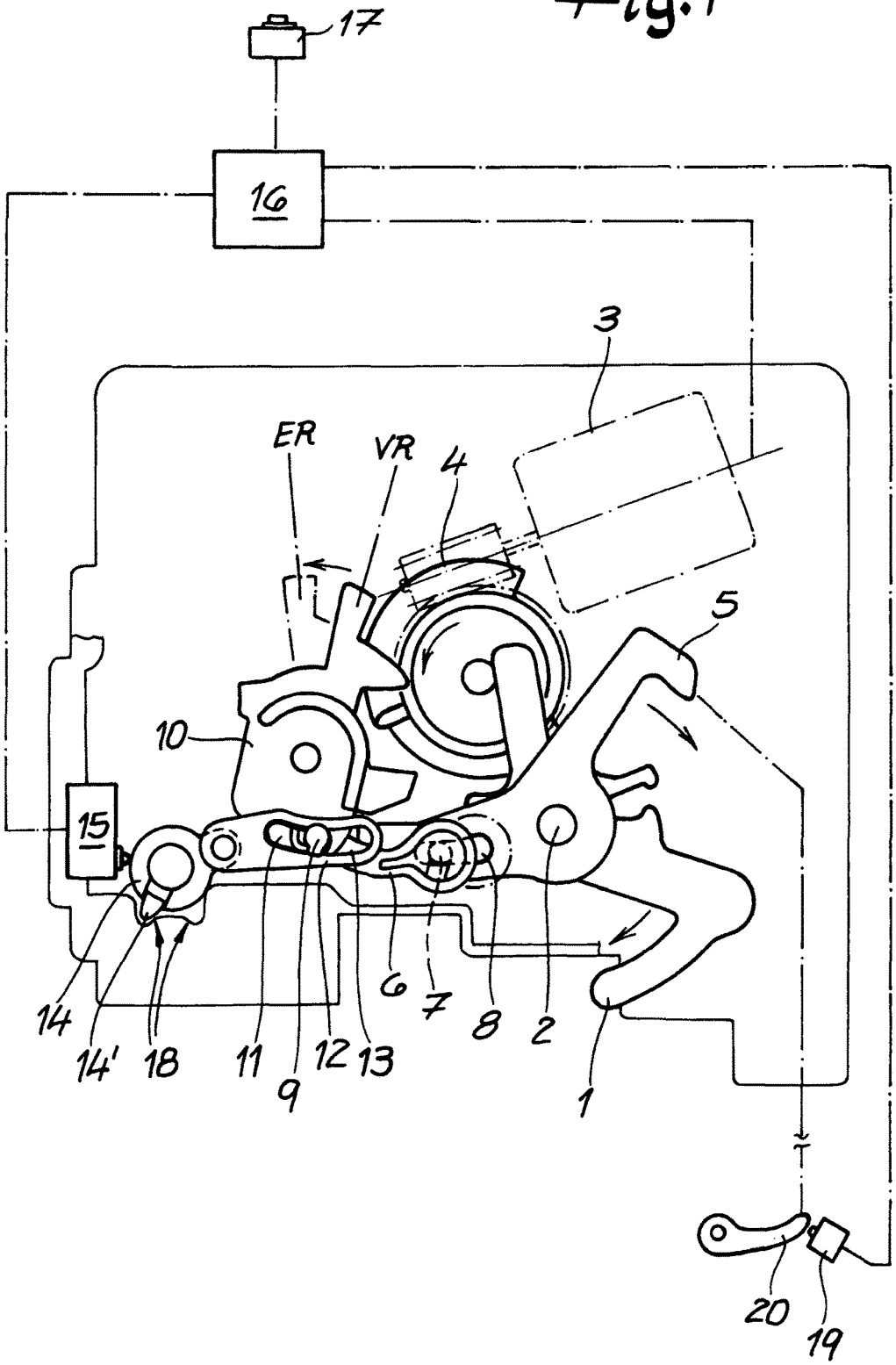

(51) Int. Cl.

| | |
|---|---|
| ***E05B 77/26*** | (2014.01) |
| ***E05B 81/06*** | (2014.01) |
| ***E05B 81/14*** | (2014.01) |
| ***E05B 81/64*** | (2014.01) |
| *E05C 3/06* | (2006.01) |
| *E05C 3/16* | (2006.01) |
| *E05B 81/76* | (2014.01) |

(52) U.S. Cl.
CPC ..... *E05B 81/14* (2013.01); *E05B 81/64* (2013.01); *E05B 81/76* (2013.01); *Y10T 292/57* (2015.04)

(58) Field of Classification Search
USPC ..... 292/201, 216, 200, 198, 197, DIG. 23
See application file for complete search history.

(56) References Cited

U.S. PATENT DOCUMENTS

| | | | | |
|---|---|---|---|---|
| 6,081,758 | A * | 6/2000 | Parvulescu | B60K 28/14 280/735 |
| 6,655,179 | B2 * | 12/2003 | Kobayashi | E05B 77/28 70/237 |
| 6,879,058 | B2 * | 4/2005 | Lorenz | E05B 77/26 292/201 |
| 7,125,057 | B2 * | 10/2006 | Coleman | E05B 77/26 292/201 |
| 8,256,805 | B2 * | 9/2012 | Ishiguro | E05B 77/26 292/201 |
| 8,789,861 | B2 * | 7/2014 | Takayanagi | E05B 77/265 292/201 |
| 8,967,678 | B2 * | 3/2015 | Rosales | 292/196 |
| 2001/0030428 | A1 * | 10/2001 | Kunst | E05B 77/26 292/201 |
| 2006/0290143 | A1 * | 12/2006 | Watanabe | E05B 77/26 292/216 |
| 2010/0235057 | A1 * | 9/2010 | Papanikolaou | E05B 81/14 701/49 |
| 2012/0248796 | A1 * | 10/2012 | Kurebayashi | E05B 81/20 292/201 |
| 2014/0001774 | A1 * | 1/2014 | Bendel | E05B 77/06 292/200 |
| 2014/0049056 | A1 * | 2/2014 | Scholz | E05B 81/14 292/200 |
| 2015/0284977 | A1 * | 10/2015 | Barmscheidt | E05B 81/14 292/200 |
| 2015/0300052 | A1 * | 10/2015 | Barmscheidt | E05B 77/02 292/201 |

FOREIGN PATENT DOCUMENTS

| | | | | |
|---|---|---|---|---|
| DE | 69902858 | T2 | 1/2003 | |
| DE | 10259972 | B4 | 2/2005 | |
| DE | 10336602 | A1 | 3/2005 | |
| EP | 0775793 | A1 | 5/1997 | |
| JP | EP 2028334 | A2 * | 2/2009 | E05B 77/26 |
| WO | WO 9743510 | | 11/1997 | |

OTHER PUBLICATIONS

Machine Translation of DE1033602A1 by Lexis Nexis Total Patent on Sep. 9, 2014.
Machine Translation of DE19916733A1 by Lexis Nexis Total Patent on Sep. 9, 2014.
Machine Translation of DE69902858T2 by Lexis Nexis Total Patent on Sep. 9, 2014.

* cited by examiner

MOTOR VEHICLE DOOR CLOSURE

REFERENCE TO RELATED APPLICATIONS

This application is the U.S. national stage application of International Patent Application No. PCT/DE2013/000153, filed Mar. 16, 2013, which claims priority of German Application No. 20 2012 003 171.6, filed Mar. 28, 2012, which are both hereby incorporated by reference.

DESCRIPTION

The invention relates to a motor vehicle door closure comprising a locking mechanism, an electric drive for the locking mechanism and a child-restraint element with a corresponding sensor, in which depending on the position of the child-restraint element determined by the sensor, the electric drive can be activatable or deactivatable for opening the locking mechanism.

Electric opening of motor vehicle door closures is commonly known with an example disclosed in EP 1 225 290 B1. In such arrangements, a handle such as an external actuating lever and/or an internal actuating lever is not mechanically connected to the locking mechanism. Instead, a sensor triggered by the handle ensures that the electric drive is supplied with power in order to be able to open the locking mechanism by means of a motor—and not manually. This reduces operating forces and a safe and reliable opening of the locking mechanism is ensured.

As usual, the locking mechanism generally comprises a rotary latch and a pawl interacting therewith. The electric drive typically lifts the pawl off the rotary latch so that it can open with the aid of a spring. A previously retained locking pin is now released. Consequently, also an associated motor vehicle door can be opened.

Apart from the aforementioned normal operation during electric opening, also a so-called emergency operation is known, associated in general with an emergency opening of the locking mechanism. In this case, EP 1 320 652 B1 describes an intermediate lever controllable by the electric drive. During emergency opening or emergency operation, the intermediate lever couples a triggering lever, acted upon by the external operating lever, with the pawl by means of a through journal. As a result, the external actuating lever can directly mechanically disengage the pawl in the event of an emergency opening or emergency operation.

In a motor vehicle door closure of the structure described above and as disclosed in DE 102 59 972 B4, a motor vehicle door closure system is provided, containing a mechanical child-restraint lever as child-restraint element. The child-restraint lever contains means for sensing the mechanical switching state. It also contains a control unit activating or deactivating a handle or an electrical internal actuating means, depending on an output signal of the sensor assigned to the safety element. As a result, the known child-restraint can be electrically activated and deactivated In addition, an internal child-restraint switch is provided with the aid of which the internal door handle and thus also the internal door handle switch can be deactivated at times. As a result, a child or an adult person can leave the vehicle by themselves despite the child restraint being activated. This means that the electrical internal actuation is in this case only released if a driver of a vehicle actually decides to do so.

The invention is based on the technical problem of further developing such a motor vehicle door closure in such a way that the functional reliability is increased on the whole and, in particular, during and after an accident and that a cost-saving simplification of the prior art solution is achieved In order to solve this technical problem, a generic motor vehicle door closure of the invention is characterized by the electric drive moving the activated child-restraint element into its deactivated position during emergency operation, In its activated position, the child-restraint element ensures as usual that an associated internal actuating lever does no longer function. In other words, a passenger cannot open a respective motor vehicle door from the inside if the child-restraint element has been activated. In contrast, an opening actuation by means of an external actuating lever on the respective motor vehicle door is still possible, corresponding to the usual child-restraint function.

In case of an emergency operation or where an emergency opening is required, the invention ensures that the activated child-restraint element is purely electrically moved into its deactivated function during such an emergency operation. As a result, a motor vehicle passenger can open a respective motor vehicle door during such an emergency operation despite the child-restraint element being activated and is thus able to escape.

The same also applies to front passengers who in such a case may wish or have to leave a respective motor vehicle via the rear doors equipped with child restraints.

The overall design is such that, as part of the emergency operation in case of the failure of the electronics, the respective motor vehicle door closure can in any case be mechanically opened using an external door handle.

Advantageously, a switch or generally a sensor is assigned to the child-restraint element. With the aid of this switch or sensor, the child restraint can be temporarily deactivated. The switch can be advantageously arranged in a dashboard inside the respective motor vehicle and is in this context designed as a dashboard switch. When this switch or dashboard switch is, for instance, activated by the driver, the previously activated child-restraint element can—at least temporarily—be deactivated. This offers the option of, for instance, an adult being able to open a respective rear door from the inside, even if the child restraint is mechanically engaged. It has proven to be advantageous for the locking and unlocking switch to be used as a switch for the door lock.

Generally a control unit is provided with the aid of which individual child-restraint elements are selectively activated/deactivated in a motor vehicle. In addition, the control unit can ensure that the one switch or the corresponding switch belonging to the respective motor vehicle door closure is evaluated and that the respective motor vehicle door lock is acted upon accordingly. This means that the control unit allows individual motor vehicle doors to be specifically activated and deactivated as regards their child-restraint elements and at least temporarily. This can generally be achieved by one or several switches or by menu controls. This offers the driver the option of deactivating individual or all child-restraint elements when required allowing passengers to leave the vehicle without restriction.

From a design point the arrangement is generally such that the child-restraint element cooperates with a coupling lever by means of a follower. The coupling lever in turn ensures that the follower is coupled to a locking lever. The coupling lever can also be displaceably mounted on the actuating lever.

If the child-restraint element is in its deactivated position, the follower and the coupling lever allow movements of the locking lever. That is the usual and common functionality.

This means that the deactivated child restraint allows the locking lever to be moved into its "unlocked" as well as into its "locked" position.

If, however, the child-restraint element is in its active or activated position, the follower and the coupling lever ensure that the locking lever is retained in its "locked" position. The transition of the child-restraint element from its "deactivated" to its "activated" position ensures anyway that the coupling lever is moved into its "locked" position provided that it was previously in its "unlocked" position.

As already explained, the coupling lever is displaceably mounted on the actuating lever. Depending on its position on the actuating lever, the coupling lever ensures that the actuating lever is mechanically coupled to a triggering lever or that the actuating lever carries out an idle stroke in relation to the respective triggering lever. The actuating lever is typically an internal actuating lever.

In most eases the design Is such that the actuating lever or internal actuating lever and the triggering lever are mounted on the same axis. At this point usually an axis of rotation anchored in the lock case or generally in the lock housing; on which the actuating lever and the triggering lever are mounted.

Generally, the coupling lever contains two actuating journals on both of its opposing ends. The actuating journal can be designed as a locking journal. The locking journal extends through a recess on the follower and also through the locking lever or a recess provided in the locking lever. The other actuating journals is, on the other hand, designed as a triggering journal. The triggering journal extends through a recess in the actuating lever and cooperates in the coupled position of the coupling lever with an edge or an extension arm of the triggering lever. In this coupled position of the coupling lever, an actuation of the actuating lever ensures that the triggering lever mounted on the same axis follows and can also follow this movement. With the aid of the triggering lever, the pawl can be mechanically lifted off the rotary latch when the coupling lever is coupled so that the lever opens with the aid of a spring.

In the solution provided by the invention, the child restraint remains mechanically activated during electrical deactivation. It is merely made possible that after unlocking also the electric internal activation for opening the motor vehicle door lock is temporarily activated.

Figure 2:
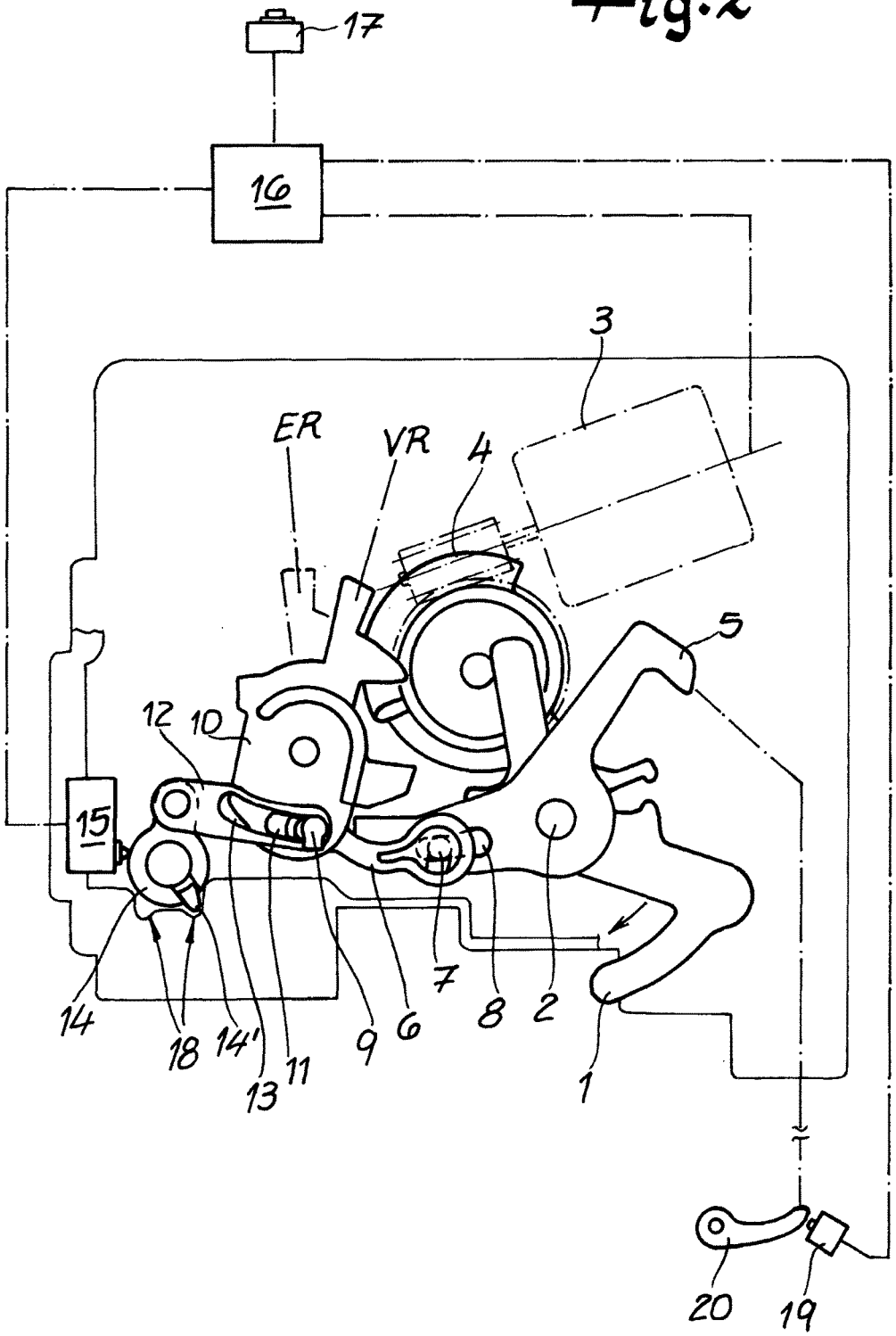
Figure 3:
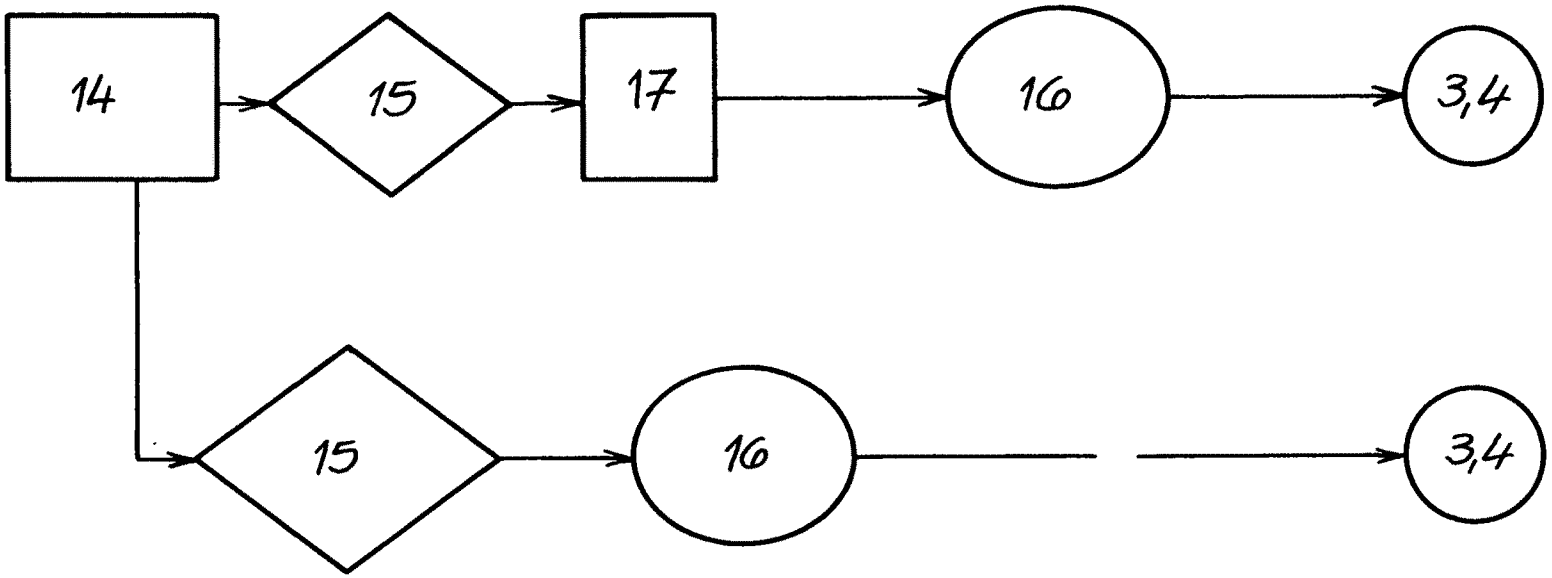

Below, the invention is explained in more detail with reference to a drawing showing only one embodiment, in which:

FIG. 1 shows a motor vehicle door closure in the position "locked and child restraint deactivated", FIG. 2 shows the motor vehicle door closure according to FIG. 1 in the position "locked and child restraint activated" and FIG. 3 shows a general functional diagram.

FIGS. 1 and 2 show a motor vehicle door closure with a locking mechanism comprising a rotary latch and pawl—not shown in detail. A triggering lever 1 can act on this pawl to open it if the triggering lever 1 is pivoted around its associated axis 2 in clockwise direction, as indicated by an arrow in FIG. 1. Such a clockwise movement of the triggering lever 1 around its axis 2 does correspond with the pawl—not shown in detail—being pivoted away from its engagement in the rotary latch so that the rotary latch can open with the aid of a spring. A previously retained locking bolt is released and the respective motor vehicle door can be opened.

The described opening movement of the triggering lever 1 can be either mechanical or motor driven. The motorized opening of the triggering lever 1 is provided by an electrical drive 3, 4, only indicated in FIG. 1 for the sake of clarity and comprising mainly an electric motor 3 and a driven pulley 4 driven by the electric motor 3. If the driven pulley 4 in the example of FIG. 1 moves in counter clockwise direction, an opening contour provided on the driven pulley 4 and not expressly shown, is able to act upon the triggering lever 1 which as a result of being acted upon, pivots around axis 2 in indicated clockwise direction, lifting the pawl off the rotary latch as described.

Alternatively the triggering lever 1 can also be mechanically pivoted in clockwise direction around its axis 2 with the aid of the actuating lever 5. In the example, the actuating lever 5 is an internal actuating lever 5 in the example although the invention is not limited to this. The actuating lever 5 and the triggering lever 1 are arranged on the same axis and do thus have a common axis 2.

A coupling lever 6 is displaceably mounted on the actuating lever 5. On the end facing the actuating lever 5, the coupling lever 6 contains an actuating journal 7—only indicated—which in this case is a triggering journal 7. The triggering journal 7 extends through a recess 8 in the actuating lever or internal actuating lever 5 and can cooperate with an edge or an extension arm of the triggering lever 1 in the coupled position of the coupling lever 6.

If the coupling lever 6 is in its right end position—only indicated by a dashed/dotted line in FIG. 1—in relation to recess 8 in the actuating lever 5 ("coupled" position), the triggering journal 7 acts on the coupling lever 6 with the triggering lever 1, as soon as the actuating lever or internal actuating lever 5 is pivoted around axis 2, shared with triggering lever 1. This may be achieved by the internal door handle 20 or respective acting on the internal door handle 20.

In the "coupled" position of the coupling lever 6 a continuous mechanical connection is consequently provided between the actuating lever or the internal actuating lever 5, the triggering lever 1 as well as the locking mechanism so that the acted upon internal door handle 20 can open the locking mechanism. The position "coupled" of the coupling lever 6 and the position "unlocked" (ER) of a locking lever 10, explained in detail below, corresponds to this position. In this functional position, also a child restraint, described in detail below, is disengaged or deactivated.

In the example, the coupling lever 6 contains two actuating journals 7, 9. One actuating journal 7 is, as already described, a triggering journal 7 and operates in the position "coupled" of the coupling lever 6 and with the child restraint not engaged or disengaged and in the position "unlocked" of the locking lever 10 as a mechanical coupling between the actuating lever 5 and the triggering lever 1—as described. The other actuating journal 9 provided at the end of the coupling lever 6 is a locking journal 9. The locking journal 9 extends through the locking lever 10 or a recess 11 provided in the locking lever 10 at this point as well as a follower 12, also containing a recess 13 accommodating and guiding the locking journal 9.

As already indicated, the motor vehicle door closure contains a child restraint or a child-restraint function so that the motor vehicle door closure is primarily used for rear doors in passenger cars. In this context, the child restraint contains a child-restraint element 14. The child restraint also includes a sensor 15 assigned to the child-restraint element 14. The position of the child-restraint element 14 can be determined with the sensor 15. The sensor 15 is connected to a control unit 16, also acting on the electric motor 3 when required, initiating the already described electric opening.

Furthermore, a switch 17 is provided which can in this case be a dashboard switch 17. The signals of the said switch 17 are also processed by the control unit 16. The switch or the dashboard switch 17 can be arranged inside the car body and is preferably designed as a locking and unlocking switch 17.

As part of the embodiment, the child-restraint element 14 can generally assume two different positions. In FIG. 1, the child-restraint element 14 is in its position "disengaged or deactivated", whilst the functional position of FIG. 2 corresponds to position "engaged or activated" of the child-restraint element 14 and thus the child restraint as a whole. The child-restraint element 14 is thus an activation nut that can, as usual, be mechanically pivoted from outside of the motor vehicle door closure with the aid of a spanner, a screwdriver, etc. In order to be able to fix the different positions of the child-restraint element 14, it contains a molded catch 14', cooperating with a detent recess 18 on the lock housing.

Depending on which position of the child-restraint element 14 is transmitted to the control unit 16 by the respective sensor 15, said unit ensures that the electric motor 3 or the electric drive 3, 4 are activated or deactivated for opening the locking mechanism. If the child-restraint element 14 is, for instance, in its position "disengaged or deactivated", as shown in FIG. 1, the locking mechanism can be electrically opened if the control unit 16 receives an additional signal from a sensor 19. This sensor 19 is a sensor 19, sensing the movements of an internal door handle 20. If the internal door handle 20 is pulled or activated, the sensor 19 is also acted upon, which the control unit 16 in turn interprets as an opening request.

If the control unit 16 determines in this case the child-restraint element 14 is in its "deactivated" position (by checking the respective sensor 15), an (electric) opening of the shown motor vehicle door closure from the inside is permitted.

This means that in the position child restraint or in the position "deactivated" of the child-restraint element 14 the locking lever 10 can assume the position "unlocked (ER)" and "locked (VR)". Only once the locking lever 10 has been moved into the "unlocked (ER)" position, is the coupling lever 6 in its "coupled" position. In this case also the actuating lever 5 and the triggering lever 1 are engaged.

In order to, for instance, open the locking mechanism in the functional position of FIG. 1, when the electric drive has failed, a so-called "two-stroke activation" of the actuating lever 5 is required. In order to achieve this, the actuating lever 5 ensures during a first stroke i.e. during a rotating movement in clockwise direction, that the locking lever 10 is moved from the "locked" (VR) position of FIG. 1 into the "unlocked (ER)" position. At the same time, the coupling lever 6 is "coupled". During the next stroke the actuating lever 5 can then act on the triggering lever 1 with the aid of the coupling lever 6 in order to open the locking mechanism.

When the child restraint is "activated" and thus the child-restraint element 14 is "activated", acting on the actuating lever 5 around axis 2 in clockwise direction ensures that the coupling lever 6 is basically moved up in relation to the position of FIG. 2 or pivoted around the locking journal 9 acting as an axis in counter clockwise direction and can, in any case, not interact with the triggering lever 1. This means that any activation of the internal door handle 20 has no result or corresponds to a desired idle stroke. The motor vehicle door closure is "locked" and the child restraint has been applied. Any internal activation is consequently without result.

If the switch or dashboard switch 17 is activated in this functional position and the control unit 16 receives a certain signal, the control unit 16 unlocks the locking mechanism and a temporary deactivation of the child-restraint whilst the switch is being held. In this case, the signal of the sensor 15 assigned to the child-restraint element 14 is bridged or ignored. This means that the switch 17 causes a temporary electric deactivation of the activated child restraint in which the child-restraint element 14 remains unchanged in the position "activated" as shown in FIG. 2. This is generally shown in the functional overview of FIG. 3.

It is apparent that there are two options when the child-restraint element 14 is activated. If in this functional position and with the sensor 15 being acted upon, the switch or dashboard switch 17 is activated, this is interpreted by the control unit 16 in such a way that the electric drive 3, 4 can be acted upon, as shown in the top sequence of the diagram.

If, however, the additional switch 17 is not activated, the acted-on sensor 15 together with the control unit 16 scanning sensor 15, ensures that the electric drive 3, 4 is not acted upon. This is shown in the bottom part of FIG. 3

The invention claimed is:

1. Motor vehicle door closure comprising a locking mechanism, an electric drive for the locking mechanism and a child-restraint element with a corresponding sensor, in which depending on the position of the child-restraint element detected by the sensor the electric drive can be activated or deactivated regarding the opening of the locking mechanism, wherein the child-restraint element interacts with a coupling lever containing two actuating journals by means of a follower, wherein the coupling lever couples the follower to a locking lever, wherein the first actuating journal is a locking pin and extends through the locking lever and a recess in the follower, wherein during an emergency operation the activated child-restraint element can be deactivated by a switch and that the locking mechanism can be opened by the electric drive.

2. Motor vehicle door closure according to claim 1 wherein at least one switch is assigned to the child-restraint element, selectively provides a temporary electric deactivation of the activated child restraint.

3. Motor vehicle door closure according to claim 2, wherein the switch is a dashboard switch inside a motor vehicle and is at the same time a locking and unlocking switch.

4. Motor vehicle door closure according to claim 1, wherein a control unit is provided, with the aid of which individual child-restraint elements are optionally activated/deactivated and which evaluates the respective switch and acts on the respective electric drive accordingly.

5. Motor vehicle door closure according to claim 1, wherein the coupling lever couples the follower to a locking lever.

6. Motor vehicle door closure according to claim 1, wherein the coupling lever is displaceably arranged on an actuating lever.

7. Motor vehicle door closure according to claim 1, wherein the follower and the coupling lever permit movements of the locking lever in the deactivated position of the child-restraint element.

8. Motor vehicle door closure according to claim 6, wherein the follower and the coupling lever hold the locking lever in its "locked" position when the child-restraint element is in activated position.

9. Motor vehicle door closure according to claim 6, wherein the coupling lever mechanically couples the actuating lever to a triggering lever or causes an idle stroke of the actuating lever in relation to the triggering lever depending on the position of the coupling lever on the actuating lever.

10. Motor vehicle door closure according to claim 9, wherein the actuating lever and the triggering lever are arranged on the same axis.

11. Motor vehicle door closure according to claim 1, wherein one actuating journal on the coupling lever extends through a recess in the actuating lever.

12. Motor vehicle door closure according to claim 5, wherein the coupling lever is displaceably arranged on an actuating lever.

13. Motor vehicle door closure according to claim 12, wherein the follower and the coupling lever permit movements of the locking lever in the deactivated position of the child-restraint element.

14. Motor vehicle door closure according to claim 13, wherein the follower and the coupling lever hold the locking lever in its "locked" position when the child-restraint element is in activated position.

15. Motor vehicle door closure according to claim 14, wherein the coupling lever mechanically couples the actuating lever to a triggering lever or causes an idle stroke of the actuating lever in relation to the triggering lever depending on the position of the coupling lever on the actuating lever.

16. Motor vehicle door closure comprising:

a locking mechanism, an electric drive for the locking mechanism and a child-restraint element with a corresponding sensor, in which depending on the position of the child-restraint element detected by the sensor the electric drive can be activated or deactivated regarding the opening of the locking mechanism, wherein the child-restraint element interacts with a coupling lever by means of a follower, wherein the coupling lever couples the follower to a locking lever, wherein during an emergency operation the activated child-restraint element can be deactivated by a switch and that the locking mechanism can be opened by the electric drive, wherein the coupling lever is displaceably arranged on an actuating lever, wherein the follower and the coupling lever permit movements of the locking lever in the deactivated position of the child-restraint element, wherein the follower and the coupling lever hold the locking lever in its "locked" position when the child-restraint element is in activated position, wherein the coupling lever mechanically couples the actuating lever to a triggering lever or causes an idle stroke of the actuating lever in relation to the triggering lever depending on the position of the coupling lever on the actuating lever wherein the actuating lever and the triggering lever are arranged on the same axis.

17. Motor vehicle door closure according to claim 16, wherein the coupling lever contains two actuating journals.

18. Motor vehicle door closure comprising a locking mechanism, an electric drive for the locking mechanism and a child-restraint element with a corresponding sensor, in which depending on the position of the child-restraint element detected by the sensor the electric drive can be activated or deactivated regarding the opening of the locking mechanism, wherein the child-restraint element interacts with a coupling lever containing two actuating journals by means of a follower, wherein the coupling lever couples the follower to a locking lever, wherein during an emergency operation the activated child-restraint element can be deactivated by a switch and that the locking mechanism can be opened by the electric drive and wherein one actuating journal on the coupling lever extends through a recess in the actuating lever.

* * * * *